United States Patent [19]

Bogren

[11] Patent Number: 4,619,636

[45] Date of Patent: Oct. 28, 1986

[54] METHOD AND APPARATUS FOR MANUFACTURING CONTAINER HAVING BELLOWS BOTTOM AND LID

[76] Inventor: Ingemar S. B. Bogren, 193 00 S., Sigtuna, Sweden

[21] Appl. No.: 694,672

[22] PCT Filed: May 15, 1984

[86] PCT No.: PCT/SE84/00181

§ 371 Date: Jan. 7, 1985

§ 102(e) Date: Jan. 7, 1985

[87] PCT Pub. No.: WO84/04510

PCT Pub. Date: Nov. 22, 1984

[51] Int. Cl.[4] ..... B31B 1/90; B31B 17/46

[52] U.S. Cl. ..... 493/109; 493/103; 493/474

[58] Field of Search ..... 493/108, 109, 102, 103, 493/104, 105, 474

[56] References Cited

U.S. PATENT DOCUMENTS

| | | | |
|---|---|---|---|
| 1,744,973 | 1/1930 | Kuechenmeister | 493/103 |
| 2,006,548 | 7/1935 | Halle | 493/109 |
| 2,409,460 | 10/1946 | Waters | 493/102 |
| 2,582,541 | 1/1952 | Harrison | 229/5.5 |
| 3,346,435 | 10/1967 | Beck | 156/423 |
| 3,627,171 | 12/1971 | Kaplow | 220/85 B |
| 4,187,768 | 2/1980 | Suzuki | 493/109 |

FOREIGN PATENT DOCUMENTS

| | | | |
|---|---|---|---|
| 933546 | 9/1955 | Fed. Rep. of Germany | 493/109 |
| 2243958 | 3/1974 | Fed. Rep. of Germany | 493/108 |
| 3015112 | 10/1981 | Fed. Rep. of Germany | 493/110 |
| 117235 | 5/1958 | U.S.S.R. | 493/102 |

*Primary Examiner*—Francis S. Husar
*Assistant Examiner*—William E. Terrell
*Attorney, Agent, or Firm*—James E. Nilles

[57] ABSTRACT

In a method of producing a container having a bellows bottom (2) and a protection lid (3), sleeve (1) is maintained in one axial position while a bellows bottom blank (27) is pressed into sleeve (1) to a position whereat it is welded in place by heating the thermoplastic, whereupon sleeve (1) is axially moved to and maintained in another position and lid blank (3) is pressed into sleeve (1) to position whereat lid blank (3) is similarly welded in place. The apparatus comprises a carrier (9) having an opening for supporting sleeve (1) in each of two (raised and lowered) positions, a welding ring (10) around the opening for melting the adhesive, and a plunger (11) for successively pressing the two blanks (27, 3) into sleeve (1), while at the same time shaping them and forming a folded rim or flange on each. Plunger (11) comprises a lower plunger part (17) which shapes bellows bottom (2) and which is movable relative to an upper plunger part (18), to cause expansion of a rubber ring (19) located between the plunger parts (17, 18), to force the bellows bottom rim against sleeve (1) and the latter against the welding ring (10) during welding. Welding of protection lid (3) is effected while interaction of lower plunger part (17) and carrier (9) causes lid rim and sleeve (1) to bulge outwardly, with the latter against heated welding ring (10).

15 Claims, 4 Drawing Figures

METHOD AND APPARATUS FOR MANUFACTURING CONTAINER HAVING BELLOWS BOTTOM AND LID

The present invention generally relates to containers having a body of cardboard or any other material having equivalent strength properties, and the invention is more particularly directed to containers of the type which can be damaged when subjected to pressure changes, to the packed goods or to the ambient atmosphere, and in which the container comprises a container sleeve that has at least at one end a bellows bottom which in case of pressure changes in the packed goods or the ambient atmosphere can move outwards and inwards in the container thereby compensating for the pressure changes so that the cardboard container sleeve is maintained substantially unchanged, and in which the container has a protective lid exteriorly of the bellows bottom.

The invention also relates to a method and an apparatus for the manufacture of such a container. The apparatus comprises a carrier for the container sleeve and a piston means for pressing a bellows bottom blank and a lid blank respectively into the container tube, whereby a rim of the bellows bottom blank and of the rim blank respectively are folded upwards, and in which the piston means comprises a lower part and an upper part which are axially movable in relation to each other, and an expandable means between said movable piston parts which expandable means at the compression of the two piston parts is pressed radially outwards to the inner surface of the sleeve which in turn is pressed to the carrier. The carrier is formed with a welding ring for welding the rim of the bellows bottom and the lid respectively to the inside of the container sleeve.

Containers having so called bellows bottoms are previously known, for instance from the U.S. Pat. No. 3,627,171. The said previously known container having a bellows bottom is made of sheet metal or another form-stiff material, and the bellows bottom, which is flexible and made of a flexible material is connected by being folded between the container sleeve and the lid which as conventional in manufacturing of sheet metal tins are curled inwards to provide a seal lockseam. The bellows bottom alternatively can be replaced by a type of air balloon or a slidable means which is attached to the form-stiff container.

A problem in connection with containers having a body of cardboard or a similar material is that the containers change form when subjected to internal or external pressure changes and if the pressure changes are maintained for some time, for instance for some hours to some days, the container gets an undesired permanent change of form. In case of heavy pressure changes the cardboard container even break or become unsealed. Such problems normally do not appear in containers of sheet metal or other form-stiff or shape permanent materials.

In the said previously known type of container both the bellows bottom and the end or lid are connected to the container sleeve, and thereby a pressure chamber is provided between the bellows bottom and the lid. Such a sealed pressure chamber is not acceptable in containers of cardboard or a similar non-shaped permanent material, since a pressure change should lead to a change of the container both at the area inside the bellows bottom and in the area between the bellows bottom and the lid.

For different reasons some types of goods are packed in a hot state and when the said goods are cooled down the packing volume thereof is reduced. In case of such packaging it is important to compensate the pressure change by the action of the bellows bottom so that the form of the container sleeve is maintained unchanged. This is possible only if the bellows bottom can move unprevented by an exterior lid.

Further it is important that different types of goods, especially food stuffs, are packed aseptically and the filling and the closing of the container therefore preferably is made at the place where the goods are manufactured. Machines for manufacturing and closing of cans of metal, however, are so large, complicated and expensive that they generally are not suited for small or medium size manufacturers of food stuffs or other products. Cans of sheet metal also are very bulky and lately discussions also have come up as concerns composting problems and different types of environmental problems in connection with cans of sheet metal. Also for this reason a container of the type mentioned in the said U.S. patent is less suitable for some areas of packaging.

Therefore the invention relates to a canlike container having a body of cardboard or any other material having equivalent strength properties. For eliminating the deformation and damages of the container in case of internal or external pressure changes, for instance when goods packed in a hot state are being cooled, in case of air transportation of ready filled and sealed containers etc., the container is formed with an inner bellows bottom at least at one end thereof. The bellows bottom is provided so that it can be expanded or contracted depending on pressure changes while the container maintains its shape unchanged.

There are, however, certain problems in closing and sealing of cardboard containers, and the sealing problems are increased by inserting a bellows bottom in the container, especially since the manufacture, the filling and the closing of the containers must be accomplished quickly for a rational manufacturing process. A modern method for manufacture of cardboard containers of this type makes use of a welding tool by means of which the container is closed and sealed by high frequency heat or ultrasonic heat. For this the lid and the container sleeve on their meeting surfaces are formed with a weldable material, and the lid with a folded up all around extending rim is pressed down in the sleeve so that the rim of the lid is positioned straight in front of the welding tool, for instance the welding ring. When weld connecting a bellows bottom the welding operation also must be done right in front of the welding ring. In order to give the container an attractive appearance and in order to protect the bellow bottom the container must be formed with a further lid axially outwardly of the bellows bottom and preferably connected to the inner surface of the container sleeve. The said further lid ought to have air channels in which the air volume between the bellows bottom and the protective lid can be reduced and increased when the bellows bottom is moved outwards and inwards respectively. In order to provide the bellows bottom, the pressure piston which forms and forces the bellows bottom down in the container sleeve must be designed so that the bellows bottom is cupshaped. This means that the press piston at the bottom surface thereof must be convexly formed. The protection lid cannot be inserted at the same time as the bellows bottom, and the introduction of the protection lid must be made in a separate operation, and in case the press piston has the above mentioned convexly bulged shape the protection lid cannot be formed, forced into the container sleeve and welded to the container sleeve in the same way as the bellows bottom. Also the protection lid cannot be welded to the container sleeve without moving the sleeve so that the protection lid comes in a position straight in front of the welding tool. It is expensive and complicated to execute the operation in two different machine stations and by means of two different press pistons.

The object of the invention therefore is to solve the problem of providing a method and an apparatus suitable for the manufacture of containers alternatively having or not having a bellows bottom and in which the container having a bellows bottom can be fully manufactured in one and the same machine station and by using one and the same press piston.

According to the invention the lower part of the press piston is formed with a bulge provided below the expandable means corresponding to the intended shape of the bellows bottom, and the carrier for the container sleeve is formed with means for supporting the sleeve at two different levels, viz. an upper level in which the bellows bottom is inserted and a lower level in which a protection lid is welded to the container sleeve above the bellows bottom. Preferably the bulge of the press piston is formed as a straight cylinder having a bellied, rounded or otherwise designed bottom surface so that the outer cylindrcial portion of the bulge can be used as a press surface when the protection lid is weld connected to the container sleeve. Thereby the protection lid can be formed with relatively low edges. The bulge of the press piston should be such that the bellows bottom can be moved both inwards and outwards if the outer pressure change is positive or negative respectively, and the bulge therefore may be a combination of convexly and concavely formed parts.

Further characteristics of the invention will be evident from the following detailed description in which reference will be made to the accompanying drawings.

In the drawings FIG. 1 is a cross section through the upper part of a cardboard container having a bellows bottom and manufactured in accordance with the invention.

Figure 1:
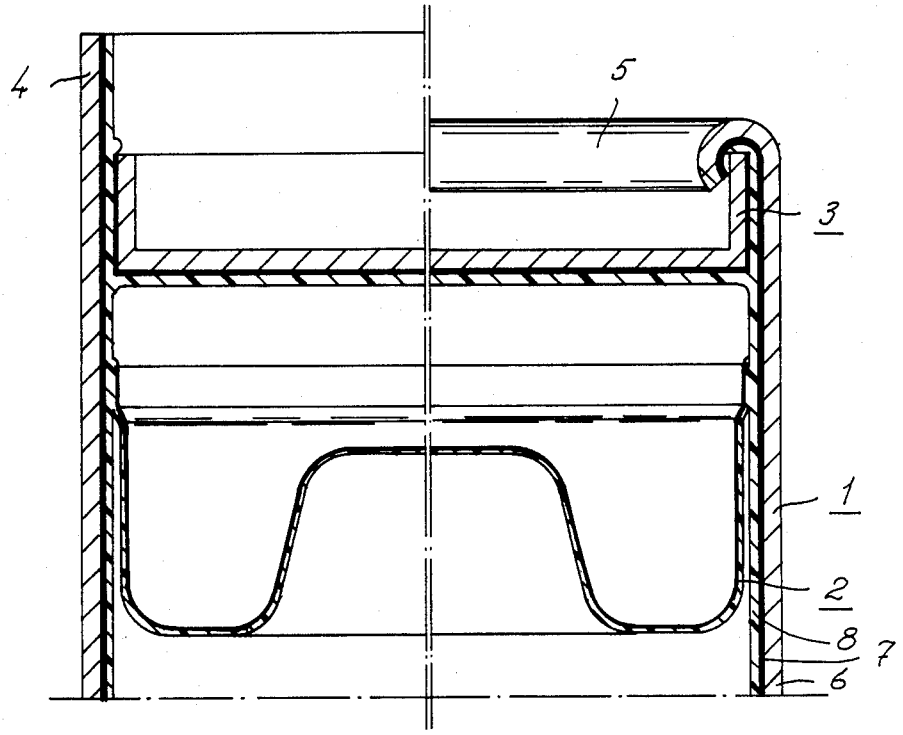

Thus the shown apparatus is intended for the manufacture of a container of cardboard or any material having equivalent stiffness or strength properties and comprising a container sleeve 1 which at the bottom can be sealed closed and which at the upper part is formed with an inner bellows bottom 2 which sealingly closes the container. Above the bellows bottom a protection lid 3 is connected to the container sleeve, and at its upper end 4 the container sleeve is formed with an inwardly curled edge 5. The container also can be formed with a bellows bottom and a protection lid both at the bottom and the top of the container.

The material of the container sleeve is a body 6 of cardboard or a similar stiff material, preferably an intermediate layer 7 adapted to absorb high frequency or ultrasonic energy, for instance an aluminum layer, and an inner layer 8 of a weldable plastic material like polyethylene. The protection lid preferably is made of the same material as that of the container sleeve or any other suitable material. The bellows bottom 2 should be made of such weldable material as is easily foldable and also is weldable. The bellows bottom is the gas seal of the container sleeve and therefore it is important that the bellows bottom carefully seals to the inner surface of the container sleeve. The bellows bottom can be made of a suitable laminated material like aluminum and polyethylene with the polyethylene layer facing the container sleeve. In the left hand part of FIG. 1 the container is shown in a partly ready state, and in the right hand part of the figure the container is shown in a final ready state.

The apparatus according to the invention, shown in FIG. 2, comprises a carrier 9 having a welding tool 10 in the form of a welding ring and an introduction piston or plunger 11 connected to known means 12 for moving the plunger 11 upwards and downwards and for providing a suitable pressure or weld connecting the edges of the bellows bottom to the inner surface of the sleeve as will be explained more in detail in the following.

The carrier 9 is intended for holding the sleeve 1 in contact with the welding ring 10 while the bellows bottom 2 and the protection lid 3 is introduced and weld connected to the inner surface of the sleeve. At the bottom edge the carrier is conically formed for providing a guide cone 13 for the sleeve which is introduced into the carrier from underneath. The weld ring 10 the is slightly conically widened in the direction upwards, for instance at an angle of about 3°. Above the weld ring 10 carrier is formed as a straight cylinder the inner periphery of which coincides with the upper edge of the weld ring 10. At a location a predetermined distance above the weld ring the carrier cavity has a shoulder 14 defining the upper position of the sleeve 1. The introduction bore above the shoulder 14 should have such area that the plunger 11 together with the bellows bottom blank or a protection lid blank can be pressed down through the carrier and into the opened end of the sleeve 1. When the bellows bottom blank or the protection lid blank are pressed down as mentioned they are formed with an upwardly projecting rim which at a later stage is weld connected to the inner surface of the sleeve. For providing a good folding up of the outer edge of the bellows bottom or the protection lid a formation ring 15 having rounded edges 16 may be mounted above the carrier 9. It should, however, be noted, that it is also possible to form the bellows bottom and the protection lid respectively by pressing the same directly into the container sleeve, and the carrier may have or not have both the shoulder 14 and the formation ring 15. The widened part of the cavity existing above the welding ring 10 makes possible a slight widening of the upper edge of the sleeve when the bellows bottom blank and the lid blank are pressed down in the sleeve, whereby it is foreseen that the sleeve is protected against damages by the said blank or blanks.

Figure 3:
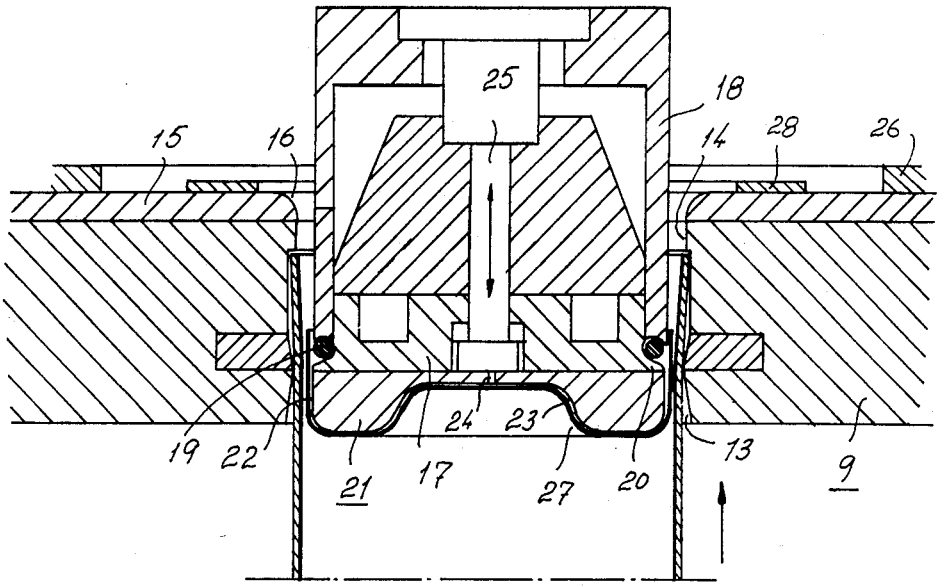
FIG. 3 shows a part of the apparatus according to FIG. 2 on a larger scale and during the welding of the bellows bottom, and FIG. 4 correspondingly shows the welding of the protection lid.

The introduction piston or the plunger 11 comprises a lower part 17 and an upper part 18 which are axially movable in relation to each other. Between the upper part 18 and the lower part 17 there is an expandable means, for instance a rubber ring 19 which changes form and is pressed radially outwards when the upper plunger part and the lower plunger part are pressed together. The lower part 17 is formed with an outwards-downwards sloping surface 20 supporting the rubber ring 19, and below said sloping surface the lower plunger part has a bulge 21, the shape of which defines the final form of the bellow bottom. The bulge 21 has sides 22 in the shape of a straight cylinder and a bottom which preferably has an evenly rounded outer edge. For making the bellows bottom assimilate both above atmospheric pressure and below atmospheric pressure it must be movable both outwards and inwards, and for this purpose the bulge 21 may be formed with one or more cavities, for instance a central cavity 23 as shown in FIG. 3. For letting out air and/or for connecting the bellows bottom blank to said cavity 23 by a suction means an evacuation bore or a suction means 24 may be provided at the center of the cavity. The upper plunger part 18 is with easy slip fit displaceable outside the lower plunger part 17 and it has an outer area which is adapted for moving the plunger 11 down together with a bellows bottom blank or a protection lid blank in the carrier 9 and into the open end of the container sleeve 1. The actuation means are adapted to move the plunger 11 to an exactly predetermined position in which the rubber ring 19 is located just in front of the welding ring 10. In this position the lower plunger part 17 is stopped by a carrier pin 25 whereas the upper plunger part 18 can be moved some further distance in relation to the lower plunger part, whereby the rubber ring 19 is compressed axially and thereby expands in the radial direction.

At the upper side of the carrier 9 there may be a first support 26 for positioning a bellows bottom blank 27 and a second support 28 for positioning a (non illustrated) protection lid blank.

Figure 2:
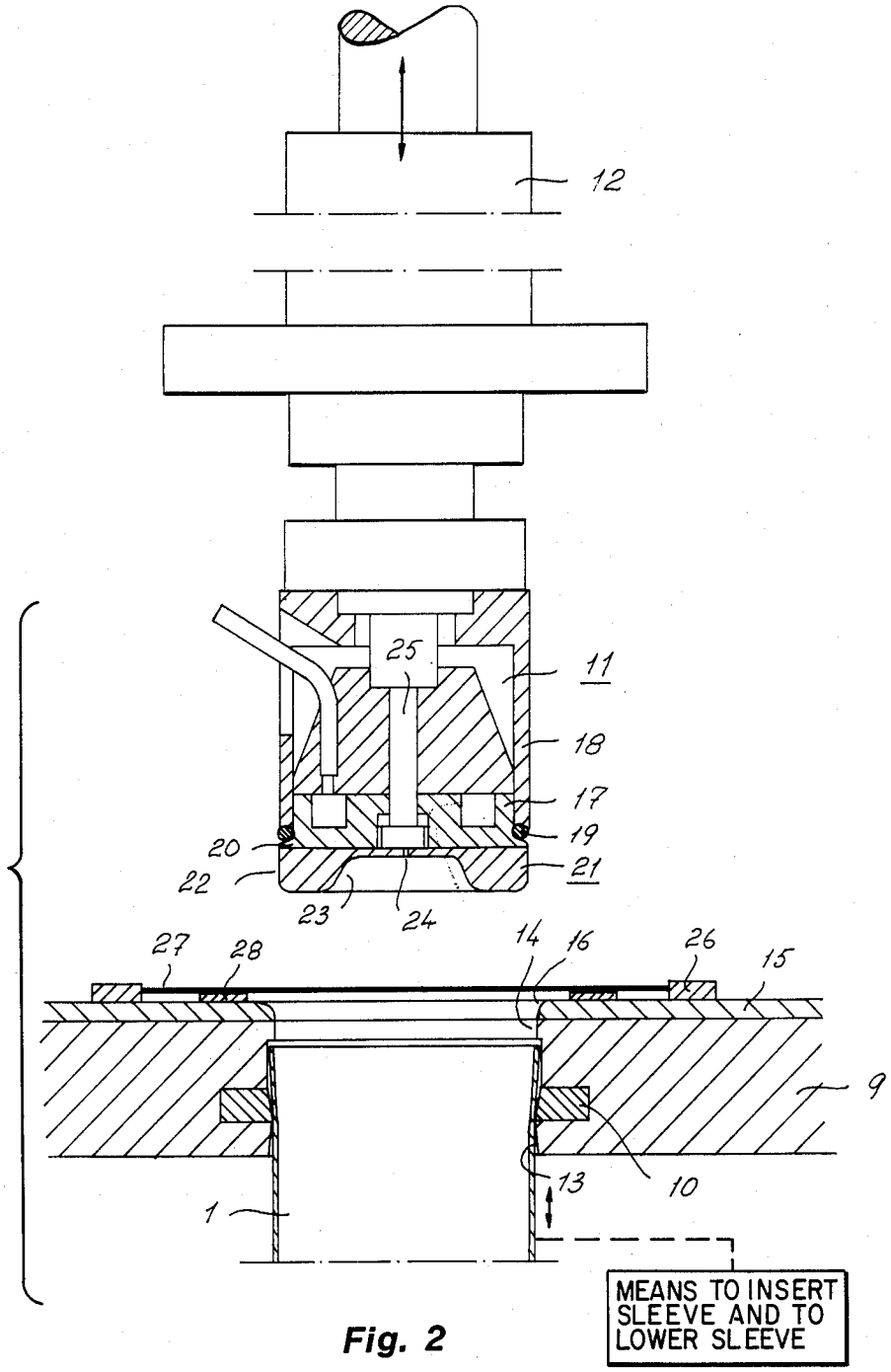
FIG. 2 is a diagrammatic cross section view through an apparatus according to the invention.
Figure 4:
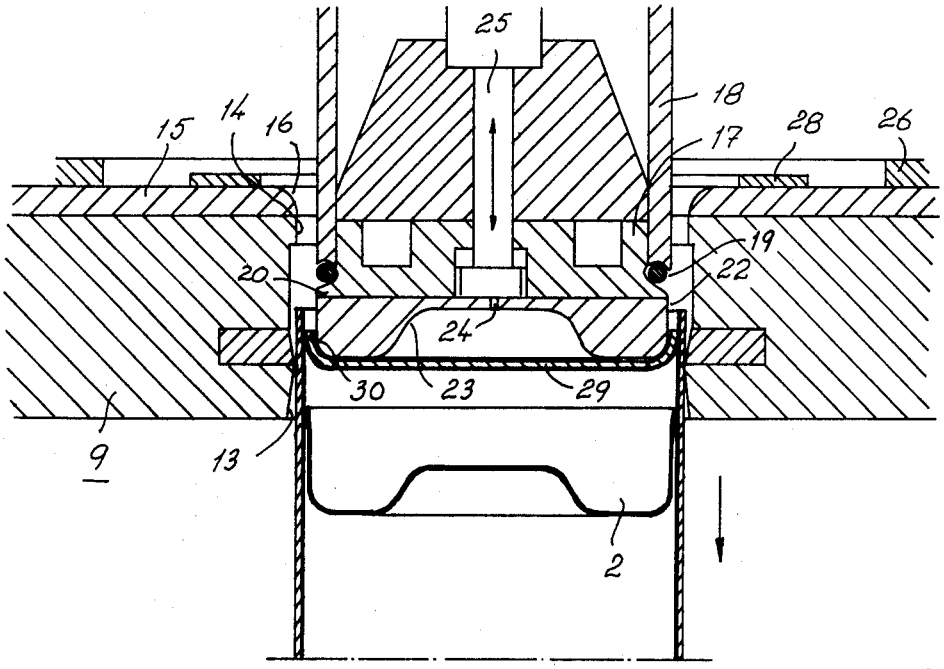

The operation of the apparatus is best evident from FIGS. 3 and 4 in combination with FIG. 2. A container sleeve 1 is from underneath moved to an upper position in the carrier 9. The said upper position for instance can be defined by the shoulder 14. A bellows bottom blank 27 is placed in the first support 26, and the plunger 11 is moved downwards by the actuation means 12, whereby the plunger forces the bellows bottom blank down through the upper part of the carrier 9 and into the open end of the sleeve. The bellows bottom blank is formed exactly to the shape of the plunger, and the plunger is adjusted so as to be stopped in a position in which the rubber ring 19 is located just in front of the welding ring 10. After the lower plunger part has been stopped by the carrier pin 25 the upper plunger part 18 is moved an exactly predetermined further distance down, whereby the rubber ring is compressed and expands in the radial direction, whereby the bellows bottom blank 27 is pressed to the inner surface of the sleeve 1. The sleeve in turn is pressed to the welding ring 10. When applying heat, high frequency or ultrasonic energy the heat is absorbed in the metal layer of the sleeve and/or the bellows bottom blank, whereby the weldable plastic layers of the sleeve and the bellows bottom rim melt together. Since the rubber ring is forcing the material towards the welding tool a very good weld contact is obtained, and since the bellows bottom blank is relatively thin a very good seal is obtained even if the bellows bottom blank has folds in the welding area. After the bellows bottom is weld connected the plunger 11 is retracted and a protection lid blank is placed in the second support 28. At the same time the container sleeve is moved a predetermined distance down so that the protection lid can be welded to the container sleeve at a predetermined distance above the bellows bottom weld. By moving the plunger 11 down it forms the protection lid blank to a lid plane 29 having an all around upwards extending rim 30. By forming the protection lid of a thicker material than the bellows bottom the lid will be pressed with sufficient force to the inner surface of the container sleeve for providing a tack welding only by the actuation of the sides 22 of the bulge 21. The plunger is thereby moved down so that the lower part of the straight bulging sides 22 is straight in front of the welding tool, and heat is supplied, whereby the protection lid is point by point or discontinuously weld connected to the sleeve. In this second stage the welding therefore is made without the actuation of the rubber ring 19. This is possible since the protection lid is made of a slightly thicker material than that of the bellows bottom and since the upwardly projection rim 30, owing to the elasticity of the material is being biassed outwards. There should not be a complete seal between the protection lid and the sleeve. On the contrary it is necessary that there is at least some perviousness between the sleeve 1 and the protection lid 3 so that air may pass the protection lid in both directions depending on pressure changes providing a movement outwards or inwards of the bellows bottom. Possibly the protection lid can be formed with one or more perforated holes or air channels.

By mounting the bulge 21 of the plunger 11 releasably one and the same plunger may be used for the manufacture both of containers having a bellows bottom as described above and for manufacture of containers without a bellows bottom, whereby the container lid is welded by the actuation of the rubber ring 19 in a position of the plunger 11 in which the rubber ring and the lid are straight in front of the welding tube 10 as described above in connection to the welding of the bellows bottom.

The moving of the sleeve 1 into two predetermined positions and the moving down of the plunger into two likewise determined positions is made by previously known means which need not be described in detail. Reference may be had to U.S. Pat. No. 3,346,435, issued Oct. 10, 1967 to R. Beck entitled "Apparatus For Forming Container From Synthetic Plastic Films" for a disclosure of known positioning means cooperable with a carrier to releasably confine a sleeve in an opening against axial displacement relative to the carrier.

It is to be understood that the above specification and the embodiment of the invention illustrated in the drawings are only illustrating examples and that different modifications may be presented within the scope of the appended claims.

Container having a bellows bottom and method and apparatus for manufacturing such container

1 container sleeve
2 bellows bottom
3 protection lid
4 upper edge
5 curled edge
6 cardboard body
7 aluminum layer
8 inner weldable layer
9 carrier
10 welding tool
11 plunger
12 actuation means
13 guide cone
14 shoulder
15 formation ring 16 rounded edges
17 lower plunger part
18 upper plunger part
19 rubber ring
20 sloping surface
21 bulging
22 sides (of 21)
23 central cavity
24 suction means
25 carrier pin
26 first support
27 bellows bottom blank
28 second support
29 lid plane
30 rim

I claim:

1. A method of manufacturing a container comprising the steps of:

providing a plunger;

providing a rigid tubular sleeve;

providing a pair of flexible deformable blanks, each blank comprising a first layer of metallic material and a second layer of thermoplastic material which becomes adhesive when melted;

maintaining said sleeve in one axial position while pressing one blank into said sleeve into a first position relative to said sleeve by operating said plunger wherein a portion of said second layer thereof contacts said tube and while exposing said one blank to radiation which effects heating of said first layer thereby causing melting and adhesion of said second layer and thereby securing said first blank in said sleeve;

and shifting and then maintaining said sleeve in another axial position while pressing the other blank into said sleeve into a second position relative to said sleeve by operating said plunger wherein a portion of said second layer thereof contacts said sleeve and while exposing said other blank to radiation which effects heating of said first layer thereby causing melting and adhesion of said second layer and thereby securing said second blank in said sleeve.

2. A method of manufacturing a container comprising the steps of:

providing a plunger;

providing a rigid tubular sleeve open at opposite ends and having an inner wall;

providing a pair of flexible deformable blanks;

at least one of said tubular sleeve and said pair of blanks comprising a layer of thermoplastic material which becomes adhesive when melted;

maintaining said sleeve in one axial position while pressing one blank into said tubular sleeve through one open end thereof into a first position relative to said tubular sleeve by operating said plunger wherein thermoplastic material is disposed between said sleeve and said one blank and melting said thermoplastic material and thereby securing said one blank in said tubular sleeve;

and shifting and then maintaining said tubular sleeve in another axial position while pressing the other blank into said tubular sleeve through said one open end into a second position spaced apart from said first position relative to said tubular sleeve by operating said plunger wherein thermoplastic material is disposed between said sleeve and said other blank and melting said thermoplastic material and thereby securing said other blank in said tubular sleeve.

3. A method according to claim 2 wherein each of said tubular sleeve and each of said blanks comprises a layer of thermoplastic material and wherein, when each blank is inserted in said tubular sleeve, thermoplastic material on said tubular sleeve makes contact with thermoplastic material on the blank.

4. A method according to claim 2 or 3 wherein each layer of thermoplastic material is associated with a layer of electrically conductive material which exhibits heating when subjected to radiant energy to thereby effect melting of its associated layer of thermoplastic material, and including the step of subjecting said layer of electrically conductive material to radiant energy while each of said blanks is in its respective position within said tubular sleeve to effect melting of the thermoplastic material.

5. A method of manufacturing a container comprising the steps of:

providing a plunger;

providing a rigid tubular sleeve open at opposite ends and having an inner wall;

providing a pair of flexible deformable blanks, each blank comprising a first layer of electrically conductive material which exhibits heating when subject to radiation and a second layer of thermoplastic material which becomes adhesive when melted in response to heat from said first layer;

maintaining said sleeve in one axial position while pressing one blank into said tubular sleeve through one open end thereof into a first position relative to said tubular sleeve by operating said plunger wherein a portion of said second layer of said one blank contacts said inner wall of said tube and while exposing said one blank to radiation which effects heating of said first layer thereof thereby causing melting and adhesion of said second layer of said one blank and thereby securing said one blank in said tubular sleeve;

and shifting and then maintaining said tubular sleeve in another axial position while pressing the other blank into said tubular sleeve through said one open end into a second position relative to said tubular sleeve by operating said plunger wherein a portion of said second layer of said other blank contacts said inner wall of said tube and while exposing said other blank to radiation which effects heating of said first layer thereof thereby causing melting and adhesion of said second layer of said other blank and thereby securing said other blank in said tubular sleeve.

6. A method according to claim 2 or 3 or 4 or 5 wherein the step of pressing each blank into said tubular sleeve includes the step of deforming each said blank so as to provide flange means thereon which engages said inner wall of said tube.

7. A method according to claim 6 including the step of forcing said flange means radially outwardly against said inner wall of said tubular sleeve at least while the second layer thereof is melted to enhance adhesion of said second layer to said inner wall of said tubular sleeve.

8. Apparatus for manufacturing a container comprising a tubular sleeve (1) having a bellows bottom (2) and a protection lid (3), both of which are mounted within said sleeve (1) in axially spaced apart relationship from each other and secured to the inner wall of said sleeve by a thermoplastic adhesive, said apparatus comprising:

a carrier (9) having an opening therethrough;

means for supporting a sleeve (1) at a predetermined position in said opening;

welding means (10) disposed adjacent said opening for effecting melting of a thermoplastic adhesive;

a plunger (11) and means associated therewith for moving said plunger (11) between a retracted position on one side of said carrier (9) and a predetermined extended position within said opening, said plunger (11) defining means in association with said sleeve supporting means for inserting a bellows bottom (2) blank and a protection lid (3) blank one at a time into said sleeve (1) into axially spaced apart relationship from each other;

means for supporting a bellows bottom (2) blank and a protection lid (3) blank between said carrier (9) and said plunger (11) when said plunger (11) is in said retracted position;

and means in said opening to effect pressing of a blank already within said sleeve (1) against the inner wall of the sleeve (1) in said opening while said thermoplastic adhesive is melted.

9. Apparatus according to claim 8 wherein said predetermined position of said sleeve (1) in said opening is a fully inserted position and wherein said predetermined extended position of said plunger (11) is a fully extended position.

10. Apparatus according to claim 9 wherein said means to effect pressing of said blank already within said sleeve (1) comprises expandable means (19) on said plunger (11) which operates to expand outwardly when said plunger (11) is in said extended position.

11. Apparatus according to claim 8 wherein said predetermined position of said sleeve (1) in said opening is a partially inserted position and wherein said predetermined extended position of said plunger (11) is a partially extended position.

12. Apparatus according to claim 11 wherein said means to effect pressing of said blank already within said sleeve (1) comprises a portion of said welding means (10) and a portion of said plunger (11) between which said blank and said sleeve are entrapped.

13. Apparatus for manufacturing a container comprising a tubular sleeve (1) having a bellows bottom (2) and a protection lid (3), both of which are mounted within said sleeve (1) in axially spaced apart relationship from each other and secured to said sleeve by a thermoplastic adhesive, said apparatus comprising:

a carrier means (9) having opposite sides and an opening therethrough for receiving and supporting a sleeve (1) inserted from one side of said carrier means (9) in either a fully inserted position or a partially inserted position;

an annular welding ring means (10) disposed around said opening for effecting melting of a thermoplastic adhesive;

a plunger (11) comprising a first plunger part (18), a relatively movable second plunger part (17), means associated therewith for effecting said relative motion and expandable means (19) disposed between those parts for expanding outwardly when said second plunger part (17) is moved toward said first plunger part (18);

means associated with said plunger for moving said plunger (11) between a retracted position on the other side of said carrier means (9), a fully extended position wherein said second plunger part (17) is within said opening and wherein said expandable means (19) is within said welding ring means (10), and a partially extended position wherein said second plunger part (17) is within said opening and wherein said expandable means (19) is past of said welding ring means (10);

and means for supporting a bellows bottom (2) blank and a protection lid (3) blank located between said carrier means (9) and said plunger (11) when the latter is in said retracted position.

14. Apparatus for manufacturing a container comprising a tubular sleeve (1) having a bellows bottom (2) and a protection lid (3), both mounted and adhesively secured within said sleeve (1) in axially spaced apart relationship from each other, said apparatus comprising:

a carrier (9) having opposite sides and a carrier opening means extending therethrough along an axis, for receiving and maintaining therein a tubular sleeve (1) inserted from one side of said carrier in either of two positions;

an annular welding ring means (10) disposed around said opening means for effecting heating of an adhesive;

a plunger (11) disposed on the other side of said carrier in a retracted position and means associated therewith for moving said plunger movable along said axis to either of two extended positions within a tubular sleeve (1) disposed in said opening;

said plunger (11) comprising a first plunger part (18) and a relatively movable second plunger part (17) mounted thereon and defining means for engaging a blank and forcing it into a tubular sleeve when said plunger (11) is moved to either of said two extended positions, means associated with said plunger for moving said second plunger part (18) axially toward said first plunger part (18) when said plunger is moved to one of said two extended positions;

means for supporting a bellows bottom blank and a protection lid blank located between said carrier and said second plunger part;

and means disposed around said plunger (11) between said first plunger part (18) and said second plunger part (17) for expanding, when said plunger (11) is in said one of said two positions, in response to the movement of said second plunger part (17) toward said first plunger part (18), said expanding being radially outwardly of said plunger (11).

15. Apparatus for manufacturing a container that comprises a substantially tubular sleeve and axially inner and outer closures at one end of the sleeve, each formed from a flat blank having a central portion and a marginal portion that is bent axially outward from said central portion and is secured to the sleeve around an inner surface thereof, said axially inner closure being supple and having its central portion of bellows-like form to accommodate expansion and contraction of container contents and said axially outer closure being substantially stiff and having a substantially flat central portion, said apparatus comprising a carrier means having an opening which has an upright axis for closely receiving and radially confining a sleeve, a welding ring means on the carrier means coaxially surrounding said opening for fusing coatings on a sleeve and on a closure to bond them, positioning means cooperating with the carrier means to releasably confine a sleeve in said opening against axial displacement relative to the carrier means, and means comprising a plunger having an axis coinciding with the axis of said opening and movable relative to the carrier means downwardly into and upwardly out of said opening for forming closures from flat blanks and inserting them into sleeves in the carrier means, said apparatus being characterized by:

(a) said plunger comprising
  (1) an upper part having an annular and coaxial downwardly facing surface,
  (2) a lower part which is confined to limited up and down motion relative to said upper part and which
    (a) defines a bottom surface on the plunger and
    (b) has an annular upwardly facing surface which is spaced above said bottom surface and which opposes said annular downwardly facing surface and cooperates with the latter in defining a radially outwardly opening groove around the plunger that is narrowed by upward movement of the lower part relative to the upper part, and
  (3) means for clamping the sleeve and closure to said welding ring means, comprising a resilient ring in said groove, said upper and lower parts defining means for radially outwardly expanding said ring by axially compressing said ring by narrowing said groove;

(b) said bottom surface on the plunger having
  (1) a central downwardly opening cavity and
  (2) a coaxial annular area surrounding said cavity that lies in a single plane normal to the axis of the plunger; and (c) said plunger having means therein comprising a suction passage, one end of which is connectable with a vacuum source and the other end of which opens to said cavity for drawing up into the cavity the central portion of a supple closure to impart bellows-like form thereto.

* * * * *